United States Patent [19]

Sheldon et al.

[11] Patent Number: 4,502,728

[45] Date of Patent: Mar. 5, 1985

[54] PORTABLE SEAT AND BACK REST

[75] Inventors: Samuel B. Sheldon, Marblehead; Jack L. Leach, Natick; Scott A. Harkness, Jamaica Plain, all of Mass.

[73] Assignee: Nepsco, Inc., Holliston, Mass.

[21] Appl. No.: 433,415

[22] Filed: Oct. 8, 1982

[51] Int. Cl.[3] ..... A47C 7/46

[52] U.S. Cl. ..... 297/284; 297/460

[58] Field of Search ..... 297/284, 460, 283, 230, 297/231, 410; 5/446, 447

[56] References Cited

U.S. PATENT DOCUMENTS

| | | | |
|---|---|---|---|
| 2,843,195 | 7/1958 | Barvaeus | 297/284 |
| 2,942,651 | 6/1960 | Binding | 297/284 |
| 3,608,960 | 9/1971 | Sherman | 297/284 |
| 3,762,769 | 10/1973 | Poschl | 297/284 |
| 3,813,148 | 5/1974 | Kraus | 297/284 |
| 4,153,293 | 5/1979 | Sheldon | 297/460 |
| 4,155,592 | 5/1979 | Tsuda et al. | 297/284 |
| 4,350,388 | 9/1982 | Weiner | 297/284 |

FOREIGN PATENT DOCUMENTS

| | | | |
|---|---|---|---|
| 1805997 | 6/1970 | Fed. Rep. of Germany | 297/284 |
| 1186413 | 8/1959 | France | 297/284 |

*Primary Examiner*—William E. Lyddane
*Assistant Examiner*—Mark W. Binder
*Attorney, Agent, or Firm*—Wolf, Greenfield & Sacks

[57] ABSTRACT

A portable seat and back rest that can be folded for convenient carrying includes a seat and back rest having spring steel plates as frames and covered by foam pads. The curvature of the back rest is controlled by a slide assembly movable on tracks on the rear of the back rest.

14 Claims, 9 Drawing Figures

PORTABLE SEAT AND BACK REST

INTRODUCTION

This invention relates to portable seats and more particularly comprises a new and improved seat and back rest assembly that has an adjustable lumbar support. The portable seat and back rest assembly is particularly designed for use in motor vehicles but may be used effectively on any chair.

At the present time there are a number of portable seats available that may be used in motor vehicles to provide improved lumbar support for the user. One such seat now available has a metal frame that is intended to be manually bent by the user to assume the desired shape. While these seats are supposed to be adjustable by modifying the bends in the frame, in fact when the frames are once bent, it is difficult if not impossible to entirely eliminate those bends while introducing other bends into the frame. Therefore, after one contour is introduced, at best it is very difficult to eliminate that contour and introduce another. Another portable seat and back rest assembly which is promoted as being adjustable is an inflatable unit. This device only enables the user to vary the stiffness or hardness of the seat and back rest assembly but does not enable the user to modify the location of the lumbar support. Yet another prior art device is provided with movable pads. However, these pads produce abrupt changes in the contour of the back, are uncomfortable and can be misplaced or lost. Other adjustable units such as that shown in prior U.S. Pat. No. 4,153,293 having a common assignee with the present application are expensive to manufacture.

The principal object of the present invention is to provide an improved portable seat and back rest assembly with an adjustable lumbar support, which is dependable, ruggedly constructed, free of knobs, pads, or other devices which may become lost or misplaced, and which provides maximum comfort.

To accomplish this and other objects, the back rest and seat assembly of the present invention includes a frame made of spring steel plates which are hinged together and define the core of the seat and back rest. Each is covered with a foam layer for added comfort, and the assembly is enclosed in an attractive cover that hides all of the adjusting mechanism. The adjusting mechanism includes a pair of tracks arranged vertically on the back side of the back rest, which tracks have substantially more rigidity than the spring steel plate which forms the core of the back rest. A slide assembly is mounted on the tracks and bears against the back of the back rest to introduce a curvature to the back rest in the form of a horizontal ridge which constitutes the lumbar support. The slide assembly includes rigid housings slidable on each track and which bear against the back of the back rest plate, and the housings are connected by flexible metal straps which support the back rest intermediate the housings. The housings include springs that bear against the tracks, and the frictional contact of the springs and tracks support the slide assembly in any elevation selected. A finger grip is provided on each of the housings to enable the user to raise and lower the slide assembly on the tracks to select the position of the lumbar support.

These and other objects and features of this invention will be better understood and appreciated from the following detailed description of one embodiment thereof, selected for purposes of illustration and shown in the accompanying drawing.

BRIEF FIGURE DESCRIPTION

Figure 5:
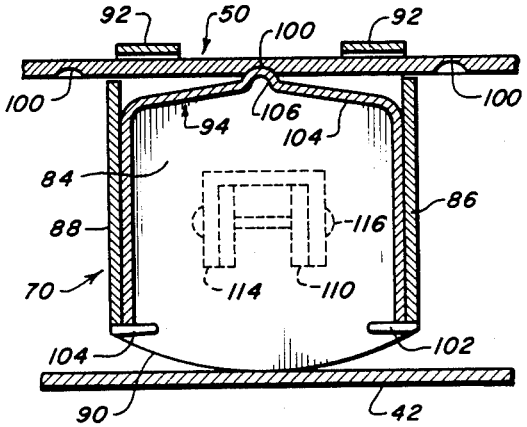
Figure 4:
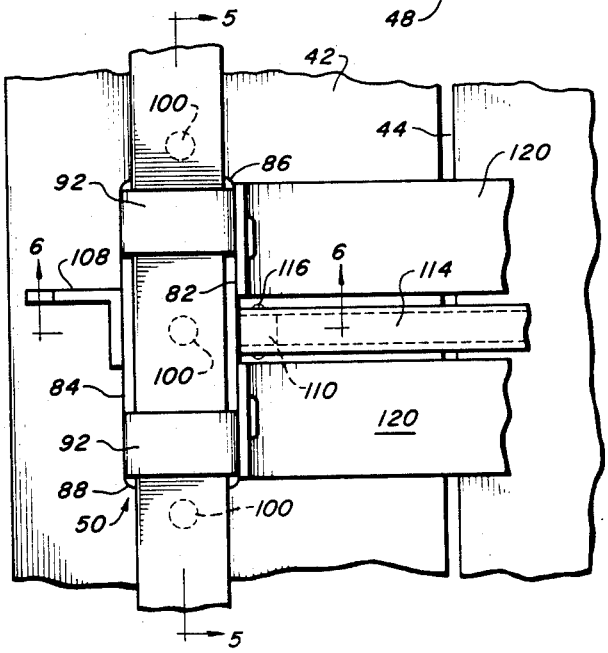
FIG. 4 is a fragmentary rear view of the lumbar support adjusting mechanism on the rear surface of the back rest.
Figure 6:
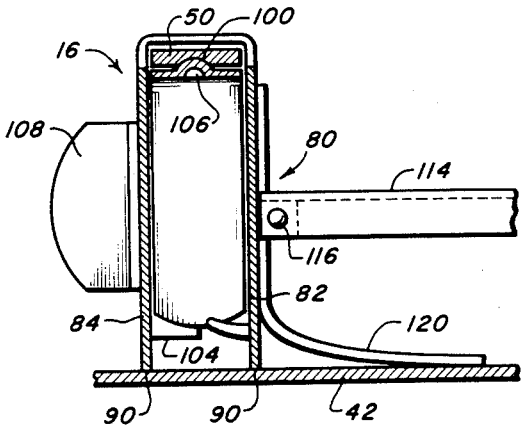
Figure 7:
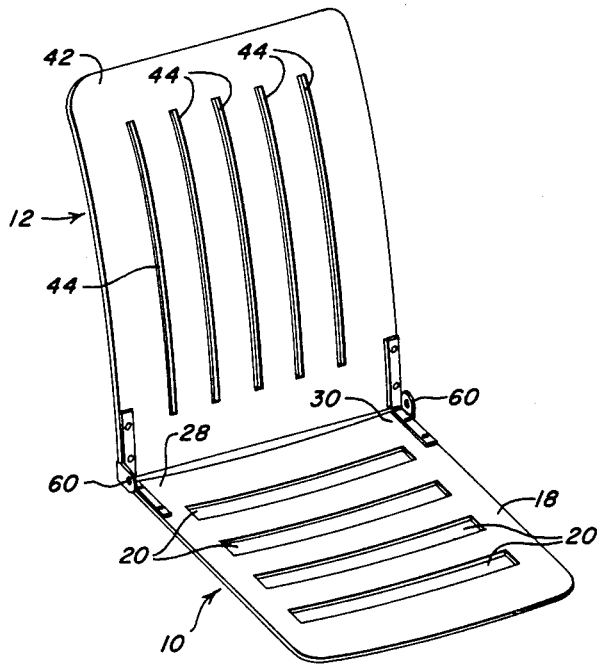
Figure 7A:
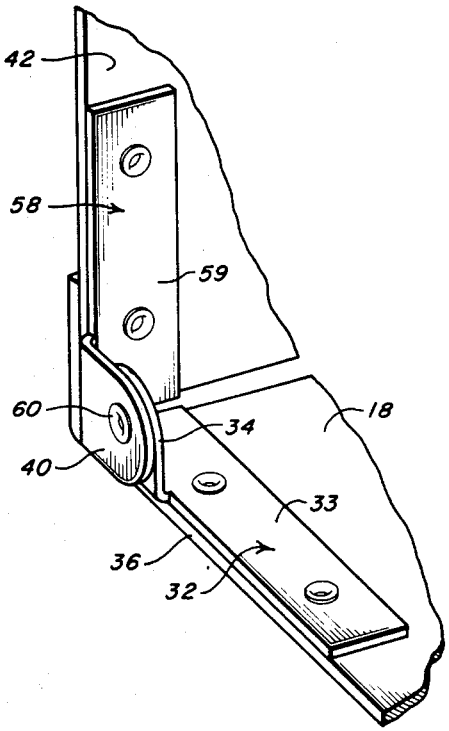
Figure 8:
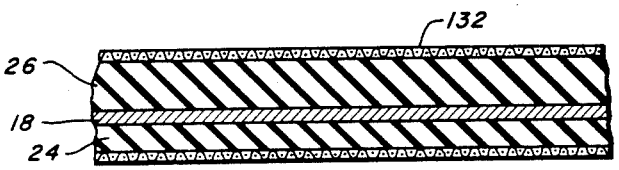

FIGS. 5 and 6 are fragmentary cross-sectional views of the adjusting mechanism taken respectively along section lines 5—5 and 6—6 in FIG. 4;

FIG. 7 is an isometric view of the base plates of the assembly and showing how they are hinged together;

FIG. 7A is an enlarged fragmentary isometric view of the hinge connecting the back and seat plates; and FIG. 8 is a cross-sectional view of the seat of the assembly.

DETAILED DESCRIPTION

The portable seat and back rest assembly of this invention includes a seat 10 and a back rest 12 which are hingedly connected together at their adjacent corners by hinges 14. The lumbar support 15 provided by the back rest 12 is adjustable in a vertical direction by means of an adjusting mechanism 16 which is mounted on the rear of the back rest 12. The several parts of the invention are described in greater detail separately below.

Seat 10 is designed to provide a firm underseating for the occupant, which is a very desirable feature of the present invention, for firm underseating is necessary if maximum comfort and back support is to be derived from the assembly. The seat includes a generally rectangular spring steel plate 18 which is approximately 15 inches square and may be approximately 0.025 inch in thickness. The plate 18 is provided with a number of transverse slots 20 which increase the flexibility of the seat by allowing it to bow more readily from front to back under the weight of the occupant. In the embodiment shown, four such slots 20 are provided, but obviously their number and width may be changed to increase or decrease its flexibility. The edges of the plate 18 are covered by a plastic tape 22 so as to protect the fabric covering 130 which encloses the assembly.

The lower surface of the spring steel plate 18 is covered by a relatively thin sheet 24 of foam material which is primarily provided to protect the seating structure upon which the portable assembly of this invention is used. That is, the thin foam sheet 24 on the bottom of the spring steel plate will prevent the plate and the slots from leaving a permanent impression on the seating structure on which the unit rests. The upper surface of the plate 18 is covered by a thicker foam sheet 26. Foam sheet 26 typically may be $\frac{3}{4}$ inch in thickness, and it essentially conforms to the plan of the spring steel plate 18. The upper foam sheet 26 enhances the comfort of the occupant.

At each of the rear corners 28 and 30 of plate 18 are hinge members 32 made of cold rolled steel and which have elongated bases 33 riveted to the top of plate 18 and upstanding hinge ears 34 that are parallel to the side edges 36 of the plate. The ears 34 cooperate with similar ears 40 on the back rest 12 to define the hinge structure, as is described more fully below.

Figure 2:
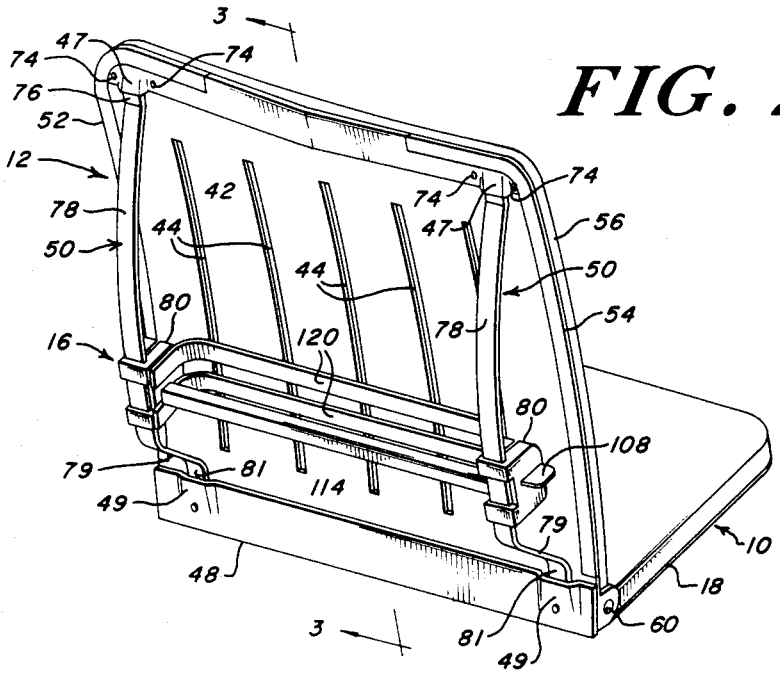
FIG. 2 is a rear isometric view of the assembly shown in FIG. 1 but with the cover removed.
Figure 3:
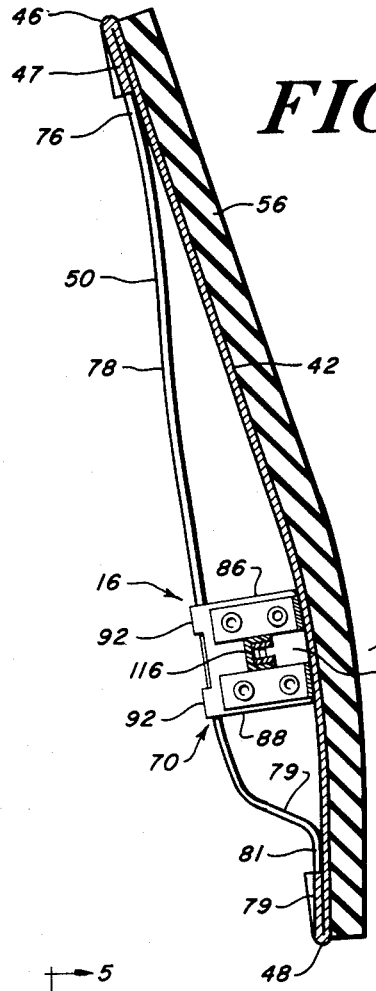
FIG. 3 is a fragmentary cross-sectional view of the back rest taken along section line 3—3 of FIG. 2.

Back rest 12 is substantially the same width as seat 10 and is approximately 18 inches high. The back rest 12 also includes a spring steel plate 42 which may be of slightly heavier gauge than the seat plate 18. In one model of the invention, the plate is made of 0.032 inch stock. The back plate 42 is provided with slots 44 that extend vertically in the plate to allow the back rest 12 to bow more readily in a side to side direction. The top and bottom edges 46 and 48 of the plate are folded over as is shown in FIGS. 2 and 3. The folded over edges 46 and 48 define pockets 47 and 49 at the top and bottom of the back rest, which receive the ends of tracks 50 that form part of the adjusting mechanism 16. The vertical side edges 52 and 54 of plate 42 are covered with plastic tape similar to the edges of the seat plate 18 to protect the cover 130.

The front surface of the spring steel sheet 42 is covered with a foam layer 56 which may be the same or preferably slightly thicker than the foam layer 26 on the seat. In one model of the invention, foam layer 56 on the back rest is one inch thick while the top foam sheet on the seat is ¾ inch thick.

At each of the lower corners of the back rest 12 and secured to the front surface thereof are hinge members 58 each having a base 59 riveted to the front surface of plate 42 along its side edges thereof and also having a forwardly extending hinge ear 40. The ears 40 are spaced slightly farther apart than the ears 34 on the seat so that when the seat and back rest are assembled, the seat hinge ears 34 lie inside the ears 40. Each pair of ears is connected by a separate hinge pin 60, and the two pins (rivets are shown) are axially aligned to ensure proper functioning of the hinge connections between the seat and back at the corners. The hinges allow the user to adjust the angular relationship of the seat and back rest and to fold up the assembly for storing or carrying. Preferably the rivets 60 are sufficiently tight to hold the back rest at any angle to the seat that may be selected by the user without making it too difficult to pivot the two to the selected angular relationship.

The adjusting mechanism 16 for the back rest that enables the user to vary the height of the lumbar support 15 is shown in detail in FIGS. 2–6. The adjusting mechanism includes the pair of tracks 50 preferably made of cold rolled steel with rounded edges. The tracks are appreciably stiffer than the back rest plate 42. One track extends along each side of the rear surface of the back rest, and a slide assembly 70 is mounted on each track. Each of the tracks 50 is riveted in the lower pocket 49 at the bottom edge 48 of plate 42. The upper ends of the tracks 50 are slidably retained in the upper pockets 47 at the top edge 46 of the plate 42 so that they may move upwardly and downwardly within the pockets as the spring steel plate 42 deforms upon adjustment of the mechanism 16. It will be appreciated that as the plate 42 bows to a greater or lesser extent, the upper ends of the tracks 50 will slide in the pockets 47. The tracks will not, however, free themselves from the pockets. Rivets 74 which retain the upper edge 46 of the plate in the folded configuration limit the width of the individual pockets 47 in the upper fold that capture the upper ends of the two tracks 50.

The upper ends 76 of tracks 50 that extend into the pockets 47 are essentially flat and lie close to or against the back surface of the back rest spring steel plate 42. Below the top ends 76 the central portions 78 of the tracks are smoothly bowed so as to diverge in a downward direction from the plate 42, and bellow the central portions 78 the tracks 50 turn abruptly toward the rear surface of the plate 42 at step 79. The lower extremity 81 of each track lies against the back of the plate 42 and enters a pocket 49. The space between the main portions 78 of the tracks and the back surface of plate 42 is occupied by the slide assembly 70.

The slide assembly 70 includes a pair of housings 80, one mounted on each of the tracks 50 between its track and the plate 42. Each housing 80 includes inner and outer side walls 82 and 84, top and bottom end walls 86 and 88 and curved front edges 90 which bear against the rear surface of plate 42 between the side edge of the plate and the outermost slot 44. A pair of bands 92 join the rear edges of the inner and outer side walls 82 and 84 and extend over the track 50 so as to retain the housing on the track. The front surface of the track is exposed to the inside of the housing 80. The two housings 80 are essentially mirror images of each other.

A number of spaced dimples or recesses 100 are formed in the front surface of each track 50 and face into the housing 80 mounted on it. The housing contains a U-shaped spring 94 which is held in place at its ends by flanges 102 off-set in the top and bottom end walls 86 and 88, and the intermediate portion 104 of the spring 94 bears against the front surface of the track as shown in FIGS. 5 and 6. The intermediate portion 104 of spring 94 is provided with a small boss 106 which is intended to selectively register with the dimples 100 so as to provide calibrations for the slide assembly and also provide additional pressure to retain the slide assembly in the position selected by the user. A finger grip 108 is welded to the outer side wall 84 of the housing so as to facilitate sliding the assembly 70 on the tracks.

The inner walls 82 of each housing carries a U-shaped bracket 110 welded to it, and the ends 112 of a U-shaped bar 114 are pinned to the brackets by pins 116 and join the two housings 80. The U-shaped bar rigidifies the slide assembly, holds the housings generally perpendicular to the rear surface of the sheet 42 and causes them to move together as the adjusting assembly is shifted on the tracks. Above and below the U-shaped bar 114 are a pair of spring straps 120 which are connected to the housings 80 and in surface-to-surface contact with the rear surface of the back rest plate 42 so as to provide yielding support for it. The spring straps 120 may be made of 0.032 inch metal stock.

The seat and back rest assembly described above is contained within a cover 130 preferably made of a breathable fabric. The cover 130 includes a front panel 132 which covers both the front of the back rest 12 and the top of the seat 10, as well as a pair of rear panels which cover the back of the back rest and the bottom of the seat, respectively. The side edges of the seat rear panel may be stitched throughout their full extent to the adjacent edges of the front panel 132 as suggested at 134 so as to form a completely enclosed pocket for the seat 10. The side edges of the rear panel on the back rest are stitched throughout only a limited portion of their full length to the adjacent portions of the side edges of the front panel 132 as suggested at 136, and the remaining portions of these side edges may be releasably secured together by snaps 138 or some other form of convenient releasable fasteners. The snaps 138 allow the user to open a portion of the back rest cover and engage the finger grips 108 to move the slide assembly 70 on the tracks 50 to the selected elevation.

Having described the invention in detail many of the advantages derived from the portable assembly of this invention will be apparent. The lumbar support 15 created in the back rest by the curvature imposed on the spring steel back rest plate 42 is yieldable in the middle (between the side edges of the back rest) because of the flexible nature of the spring straps 120. The straps 120 are flexible enough so as to deflect in the center and allow the back rest to deflect when pressure is applied against the front surface of the back rest by the occupant. And while a certain flexibility is built into the back rest and seat by virtue of the slots provided in the plates 18 and 42, respectively, the seat nevertheless does provide a relatively firm platform for the person using the unit, which is important if effective lumbar support is to be achieved.

Figure 1:
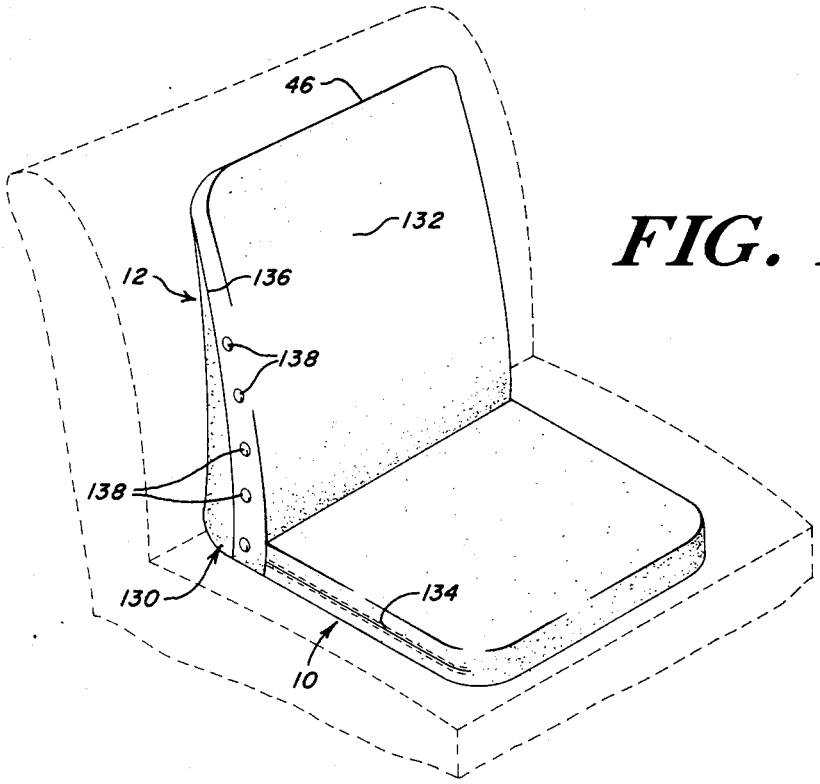
FIG. 1 is an isometric view of a portable seat and back rest assembly constructed in accordance with this invention and shown supported on an automobile seat assembly.

It will be noted in FIG. 1 that the upper edge 46 of the back rest is bowed slightly rearwardly in the middle. This configuration prevents the back rest from oil canning and makes the back rest support more comfortable. The slide assembly 70 provides a vertical adjustment for the lumbar support of approximately five to six inches, which is sufficient to accommodate substantially all body shapes and sizes. That is, the housings 80 may move through that distance on the tracks 50. And while the boss and dimples are provided on the springs and tracks, the frictional forces between the springs and the tracks are sufficient to hold the adjustable slide in any set position even when the bosses do not register with the recesses. The recesses in fact serve more as calibrations to indicate to the user a particular position for the lumbar support than to lock the support in any particular selected position. The steps 79 adjacent the bottoms of the tracks 50 allow the lumbar support to be adjusted to a position quite close to the bottom of the back rest.

The lower down the adjustable slide 70 is on the tracks, the flatter is the back rest support provided the occupant. It should be appreciated that the slide 70 imposes a curvature in the back rest as the top and bottom of the back rest are secured to the tracks 50 which are significantly more rigid than plate 42. Thus is, as the adjustable slide is raised on the tracks, the lumbar curve in the back support is raised and accentuated. This is apparent from an inspection of FIG. 3, where it can be seen that the gap between the track 50 and back rest diminishes in an upward direction. Consequently, greater distortion is imposed on the back as the slide 70 is elevated. There are two conflicting theories as to which configuration is more desirable. Some hold that the S-shaped curve in the human spine should be promoted or supported while others hold that the S-shaped curve is an imperfection in man's anatomy and that it should be straightened rather than promoted. The user will set the elevation of the lumbar support in part governed by which of the two theories he or she adopts.

From the foregoing description it will be appreciated that all of the objects of the present invention as set forth in the introduction are accomplished. The adjustable lumbar support does not impose any permanent distortions on the back rest as does the prior art back rest which is literally bent by the user to take the desired shape and which must be rebent if the location of the support is to be changed. Nevertheless, the height of the lumbar support is adjustable without having to change the elevation of the back rest itself. There are no movable or removable pads disposed in the back rest which may be uncomfortable, produce abrupt changes in the contour of the back rest or which may be lost or misplaced. Furthermore, the device is relatively simple to manufacture and is free of knobs or other types of adjusting devices that are expensive and which may malfunction. Rather, the present invention is very simple to operate merely by sliding the adjusting assembly up and down on the tracks by grasping the finger grips on the side of each housing 80. The seat while being firm, is nevertheless comfortable and exerts minimal pressure on the coccyx of the occupant.

Those skilled in the art will appreciate that numerous modifications may be made of this invention without departing from its spirit. Therefore, it is not intended that the breadth of this invention be limited to the specific embodiment illustrated and described. Rather, the scope of this invention is to be determined by the appended claims and their equivalents.

What is claimed is:

1. A portable seat and back rest assembly comprising
- a pair of spring-like plates hinged together to form a seat rest frame and a back rest frame,
- a soft foam cover on the top surface of the seat plate and on the front surface of the back rest plate,
- a pair of parallel tracks mounted on the back of the back rest plate, one adjacent each side edge of the plate,
- an adjusting slide mounted on the tracks and bearing against the back of the back rest plate and imparting a forward transverse bow in the back rest plate to provide a lumbar support,
- and friction means forming part of the slide and engaging the tracks to yieldably retain the slide at any selected vertical elevation on the tracks.

2. An assembly as defined in claim 1 further characterized by
- said plates being made of spring steel,
- and slots formed in the plates to increase their flexibility.

3. An assembly as defined in claim 1 further characterized by
- said slide including a housing mounted on each track and bearing against the back rest plate,
- and a horizontal flexible band connected between the housings and bearing against the back rest plate providing support for the plate between the tracks.

4. An assembly as defined in claim 3 further characterized by
- said tracks being spaced from the back surface of the back rest plate,
- and said housings being disposed between the tracks and that back surface.

5. An assembly as defined in claim 4 further characterized by
- said tracks being a wide, flat band,
- said housings being open on the side facing the track,
- said friction means including a spring mounted in each housing and bearing against and slidable along the track.

6. An assembly as defined in claim 4 further characterized by
- a plurality of recesses formed on one of the surfaces of the track and spring bearing against one another and a boss on the other of the surfaces bearing against one another for releasably retaining the housings and tracks in a set position.

7. A back rest assembly comprising a back rest plate made of a flexible material, a slide assembly mounted on the back surface of the back rest plate and movable vertically against the back surface to change the curvature of the plate and produce a horizontal ridge across it to press against the small of the back of the user of the back rest, said slide assembly including a pair of vertical tracks on the back of the back rest plate along the sides thereof and somewhat stiffer than the plate, a housing slidable up and down on each of the tracks and bearing against the back surface of the plate, and flexible band means connected to the two housings and bearing against the back surface of the plate between the housing, and means in the housings frictionally engaging the track to hold the assembly in any set vertical position on the tracks.

8. An assembly as defined in claim 7 further characterized by a seat pivotally secured to the bottom of the back rest plate.

9. An assembly as defined in claim 8 further characterized by said plate being made of spring steel.

10. An assembly as defined in claim 8 further characterized by a foam sheet on the front of the back rest and on the seat, and a covering for the back rest and seat, said covering being releasably closed at the back rest to provide access to the slide assembly.

11. An assembly as defined in claim 10 further characterized by said tracks being spaced from the back surface of the back rest plate, and said housings being disposed between the tracks and that back surface.

12. An assembly as defined in claim 11 further characterized by one end of each track being slidably attached to the back of the back rest plate and the other ends of the tracks being fixed thereto.

13. An assembly as defined in claim 7 further characterized by the housings having a curved edge which bears against the back surface of the plate, the radius of curvature of the edge of the housing being approximately 2 inches.

14. An assembly as defined in claim 7 further characterized by the plate being slightly curved in a vertical direction and concave when viewed from the rear, and said housing having a curved edge which bears against the back surface of the plate, the radius of curvature of the edge being substantially less than that of the plate.

* * * * *